United States Patent [19]

Herrgord

[11] Patent Number: 4,594,829

[45] Date of Patent: Jun. 17, 1986

[54] JOINT INTERLOCKING SYSTEM

[76] Inventor: Donald E. Herrgord, 85 S. Green Creek Rd., Muskegon, Mich. 49445

[21] Appl. No.: 520,812

[22] Filed: Aug. 5, 1983

[51] Int. Cl.[4] ..... E04B 1/38

[52] U.S. Cl. ..... 52/285; 52/282; 52/582

[58] Field of Search ..... 52/285, 282, 460, 461, 52/582; 403/407, 406, 405, 405.1, 406.1, 407.1

[56] References Cited

U.S. PATENT DOCUMENTS

| | | | |
|---|---|---|---|
| 1,885,330 | 11/1932 | Cherdron | 52/461 |
| 2,388,297 | 11/1945 | Slaughter | 52/282 X |
| 2,806,561 | 9/1957 | Spangler | 52/276 |
| 3,178,775 | 4/1965 | Tassell | 403/407 X |
| 3,348,459 | 10/1967 | Harvey | 94/13 |
| 3,486,287 | 12/1969 | Guillon | 52/282 X |
| 3,512,819 | 5/1970 | Morgan et al. | 52/461 |
| 3,680,898 | 8/1972 | Herrmann | 52/285 |
| 3,837,128 | 9/1974 | O'Brien | 52/282 |
| 3,854,269 | 12/1974 | Hancock | 52/754 |
| 3,886,699 | 6/1975 | Bergmann, Jr. | 52/90 |
| 4,067,155 | 1/1978 | Ruff et al. | 52/105 |
| 4,126,978 | 11/1978 | Heller | 52/461 |

FOREIGN PATENT DOCUMENTS

| | | | |
|---|---|---|---|
| 646257 | 7/1964 | Belgium | 52/582 |
| 2145902 | 3/1972 | Fed. Rep. of Germany | 52/582 |

*Primary Examiner*—Alfred C. Perham

*Attorney, Agent, or Firm*—Varnum, Riddering, Schmidt & Howlett

[57] ABSTRACT

A joint interlocking system includes T-shaped splines (30) each having arms (32), lips (34) and a center flange (36). The splines (30) are secured within slots (20) formed in the edges of panels (12) or similar articles/-members to be interlocked together in various structural configurations. H-shaped connectors (40) each include a cross bracket (42), legs (44) and inwardly directed retaining lips (46). Beads (35) are formed on the ends of the spline lips (34), and project inward toward the associated spline center flange (36). Corresponding beads (48) are formed on the ends of the connector retaining lips (46) and project inwardly toward the associated cross bracket (42). The spline beads (35) can be captured in connector pockets (50) formed by the cross bracket (42), retaining lips (46) and connector beads (48) so as to interlock the splines (30) to the connectors (40).

15 Claims, 15 Drawing Figures

JOINT INTERLOCKING SYSTEM

DESCRIPTION

1. Technical Field

The invention relates to structural connection systems and, more particularly, to joint interlocking systems for interconnecting panels or similar articles in various structural configurations.

2. Background Art

Various types of interlocking systems have been developed to construct large-area portable or otherwise temporary structures from individual panels and similar articles. For example, the U.S. patent to Bergmann, Jr. U.S. Pat. No. 3,886,699, issued June 3, 1975, discloses a building structure in which panels are joined together with T-shaped flanges at the ends of the panels and H-shaped connectors. However, the connection arrangement only allows for either straight-line or perpendicular connection between panels, and a special corner piece must be utilized to provide the perpendicular connection. When panels are utilized for temporary structures such as divider walls in modular office systems and trade show display backdrops, it is advantageous to provide a joint interlocking system which can interlock panels together in selected angled relationships. In addition, it is also advantageous for the joint interlocking system to provide for interconnection of three or more panels at a common interlocking joint.

It is also desirable to provide structural configurations whereby the relative angles between panels can be adjusted without requiring disassembly of the interlocking connection. Finally, it is advantageous to minimize the number of separate connection components associated with each interlocking joint, and to also minimize the number of different types of connection components.

DISCLOSURE OF THE INVENTION

In accordance with the invention, a joint interlocking system for interconnecting modular panels or other types of structural members includes joint assemblies having spline means secured to the panels and connector means for selectively interlocking the panels in various structural configurations. The spline means include extending arms and lips having beads at the lips terminations. The connector means include a cross bracket, legs, retaining lips extending from the legs and connector beads on terminating ends of the lips. Connector pockets are formed by the cross bracket, legs, retaining lips and connector beads, and the spline beads and connector pockets are shaped so as to provide a sliding interlocking joint.

The spline means comprise T-shaped splines, with each spline having a center flange secured to an associated panel. Each spline also includes two arms projecting laterally from the flange. A vertical slot is formed within each of the panels for receiving the center flange and rigidly securing the associated spline to the panel.

The connector means include H-shaped connectors having legs extending from terminating portions of an associated cross bracket. The retaining lips extend from terminating ends of the legs. The relative sizes of the splines and the connectors can provide a joint assembly interlocking at least two panels, wherein at least one of the panels is pivotable relative to the connector while maintaining an interlocking relationship therewith.

One of the joint assemblies can include a first H-shaped connector and first and second T-shaped splines. Two spline beads associated with the first spline are captured within two connector pockets formed on one side of the connector cross bracket. Spline beads of the second spline are captured within two connector pockets formed on the other side of the bracket. The joint assembly thus maintains the panels associated with the first and second splines in a straight-line relationship.

In another joint assembly in accordance with the invention, one of two splines interconnected to a connector has only one associated spline bead captured within one of the connector pockets. Accordingly, the angle between the panels associated with the two splines can be adjusted by pivoting the panel associated with the partially interlocked spline relative to the connector. The angle between the panels can be adjusted within a range of approximately 90° to 160°.

In another joint assembly in accordance with the invention, each of two splines has only one associated spline bead captured within connector pockets formed on opposing sides of a connector cross bracket. In this manner, the angle between the panels associated with the two splines can be adjusted by pivoting either of the panels relative to the connector. The angle between the panels in this assembly can be adjusted within the range of approximately 0° to 140°.

In another assembly in accordance with the invention, three T-shaped splines are utilized with one connector. One of the splines has two associated beads captured within two connector pockets formed on one side of the connector cross bracket. Each of the other two splines has one associated spline bead captured within the remaining connector pockets formed on the other side of the connector cross bracket.

The joint assemblies in accordance with the invention can also include two connectors and three splines. The spline beads associated with one of the splines are captured within two of the connector pockets formed on one side of the cross bracket of a first one of the connectors. Similarly, two spline beads of a second spline are captured within two connector pockets formed on one side of the cross bracket of the other connector. The spline beads of the third spline are captured within two connector pockets each formed on a separate one of the two connectors. This joint assembly can also include a fourth panel and spline having two associated spline beads captured within the remaining connector pockets of the two connectors.

Joint assemblies in accordance with the invention also include a series of connectors wherein the two retaining lips connected to one end of the cross bracket of a first connector are captured within pockets formed on one side of the cross bracket of a second connector. Correspondingly, the retaining lips connected to the other end of the cross bracket of the first connector are captured within connector pockets formed on one side of the cross bracket of an additional third connector. In this manner, the connectors can be interlocked together so as to form a chain to provide a spaced apart relationship between interlocked panels.

Also in accordance with the invention, one of the joint assemblies provides a structural configuration having a plurality of interlocked panels projecting radially outward from the assembly. This joint assembly includes splines associated with each of the panels interlocked to different ones of the H-shaped connectors. Additional connectors are each positioned between two of the connectors interlocked with splines associated with adjacent panels.

The invention can also be defined as a joint interlocking system comprising at least one elongated connector with pockets formed axially along the connector. Elongated splines are each adapted to be secured to articles to be interconnected. The splines include two extending arms and beads at the arm terminations. Each spline bead is slidably receivable within a connector pocket and shaped so as to prevent lateral separation of interconnected splines and connectors.

BRIEF DESCRIPTION OF THE DRAWINGS

A preferred embodiment of the invention will now be described with reference to the drawings in which.

BEST MODE FOR CARRYING OUT THE INVENTION

Figure 1:
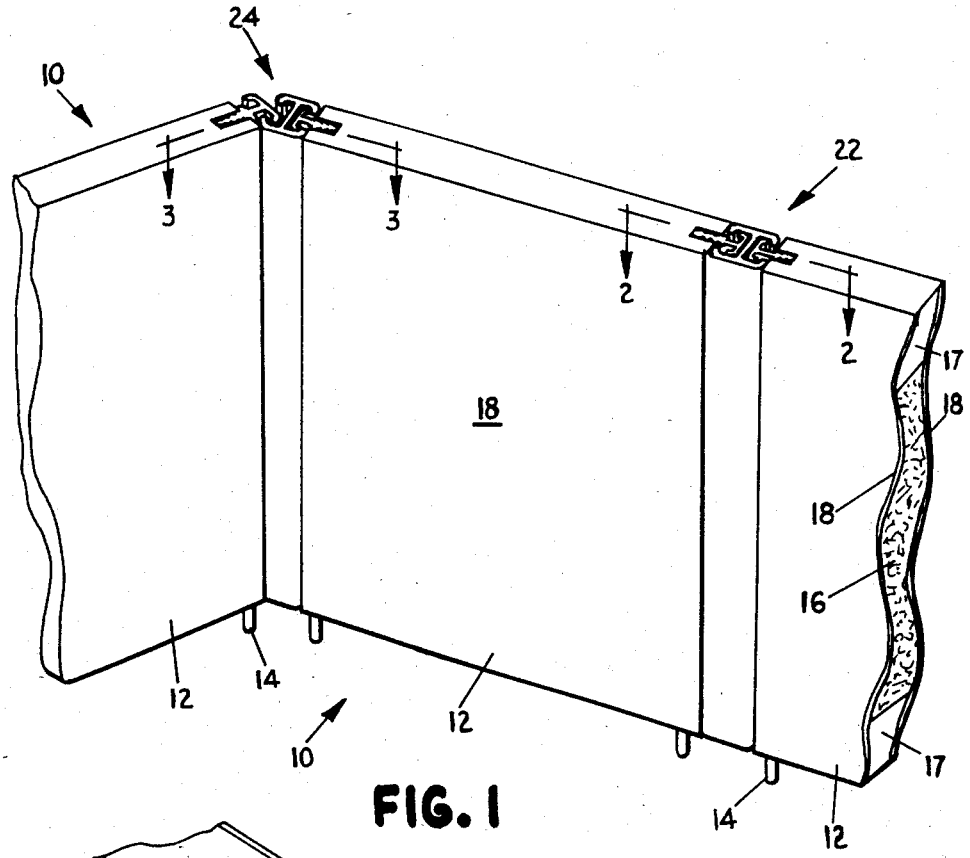
FIG. 1 is a perspective view of a joint interlocking system in accordance with the invention, with the system having three modular panels with one straight-line interlock joint assembly between two adjacent panels and one angled interlock joint assembly between another two adjacent panels.

The principles of the invention are disclosed, by way of example, in a joint interlocking system 10 as shown in FIG. 1. The interlocking system 10 is adapted to interconnect modular panels 12 in various structural configurations. Although not forming a part of the invention, each of the panels 12 can have a rectangular configuration mounted on floor supports 14 with a solid material frame 17 and an inner core portion 16 constructed in a honeycomb configuration and/or consisting of particle board, plywood or other suitable lightweight, inner core materials. Front and rear panel faces 18 can be secured to the opposing sides of each inner portion 16 and can be constructed of various types of materials to provide desired asthetics.

The panels 12 can be used for such functions as divider walls in modular office systems, and trade show display backdrops. It should be emphasized, however, that joint interlocking systems in accordance with the invention can be utilized to interconnect numerous types of modular structures where it is advantageous to easily assemble, disassemble and change the configuration of the structural components. In addition, other types of articles employing interlocking arrangements, such as toys or the like, can utilize the interlocking system in accordance with the invention.

The interlocking system 10 includes a straight-line interlock joint assembly 22. As depicted in greater detail in FIGS. 2 and 5, the joint assembly 22 interconnects two adjacent panels 12 in a straight-line configuration. The system 10 also includes an angled interlock joint assembly 24. Referring to FIGS. 3 and 6, the joint assembly 24 interconnects two adjacent panels 12 at an angled configuration.

Figure 2:
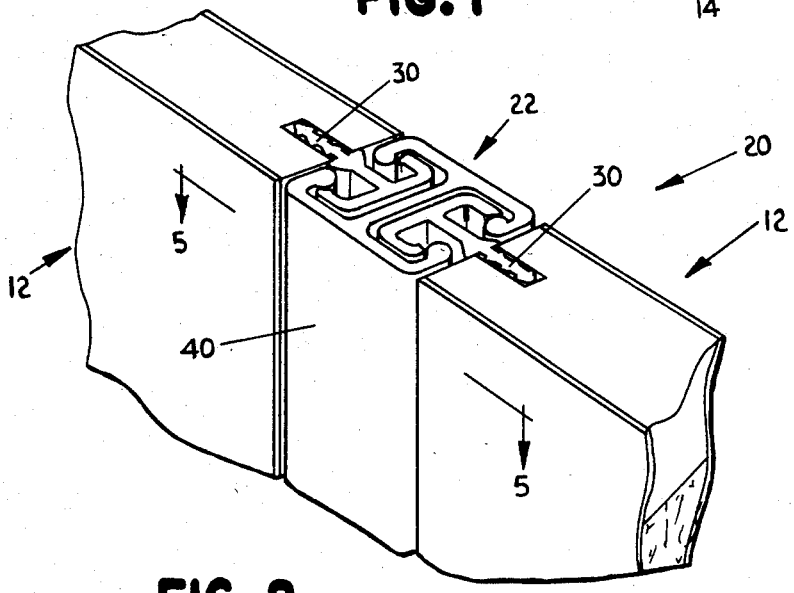
FIG. 2 is an enlarged perspective view of the straight-line interlock joint assembly shown in FIG. 1.
Figure 3:
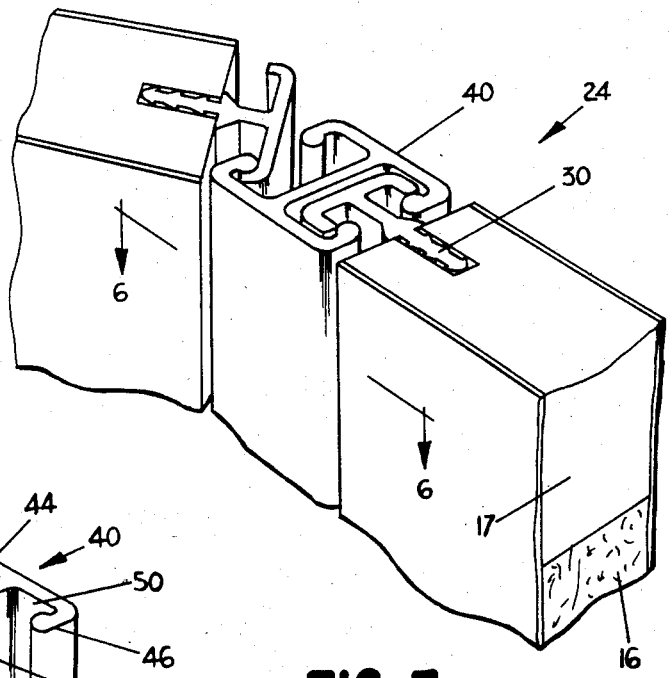
FIG. 3 is an enlarged perspective view of the angled interlock joint assembly shown in FIG. 1.

The interlock joint assemblies 22 and 24 depicted in FIGS. 2 and 3, respectively, each include a pair of identical T-shaped splines 30 and an H-shaped connector 40. Referring to the exploded view of FIG. 4, each T-shaped spline 30 includes a center flange 36 having means for securing the flange 36 within a panel slot 20 extending along a longitudinal center line of each of the edges of a panel 12. Any suitable securing means can be utilized, such as the laterally projecting ribs 38 depicted in FIG. A. The structural configuration of the ribs 38 rigidly secures the center flange 36 within slot 20 and prevent the spline 30 from pulling away from the associated panel 12. However, other securing means, such as rivot connections between the spline 30 and panel 12, can also be utilized.

Integral with the center flange 36 and extending laterally therefrom in opposing directions perpendicular to flange 36 are a pair of arms 32. Each of the arms 32 extends outwardly approximately one-half of the thickness of panel 12 and terminates in a lip 34 perpendicular to the arm 32 and projecting towards the associated panel 12. Each lip 34 terminates in a bead 35 inwardly directed toward the center flange 36. Referring to the distances $\underline{X}$ and $\underline{Y}$ shown in FIG. 4, where $\underline{X}$ is the distance from the arms 32 to the edge of panel 12 (where the flange 36 extends outward from slot 20), and $\underline{Y}$ is the distance from arms 32 to beads 35, the relationship between these distances provides the requisite spacing for use of the splines 30 in accordance with the invention.

Again referring to FIG. 4, the H-shaped connector 40 includes a cross bracket 42, with each end of the cross bracket 42 integral with a pair of legs 44 extending in opposing directions perpendicular to the bracket 42. Each of the legs 44 terminates in an inwardly directed retaining lip 46 having a bead 48 inwardly directed toward the cross bracket 42. A pocket 50 is formed at each of the four corners of connector 40 by the cross bracket 42, a retaining lip 46 and an associated connector bead 48.

Figure 4:
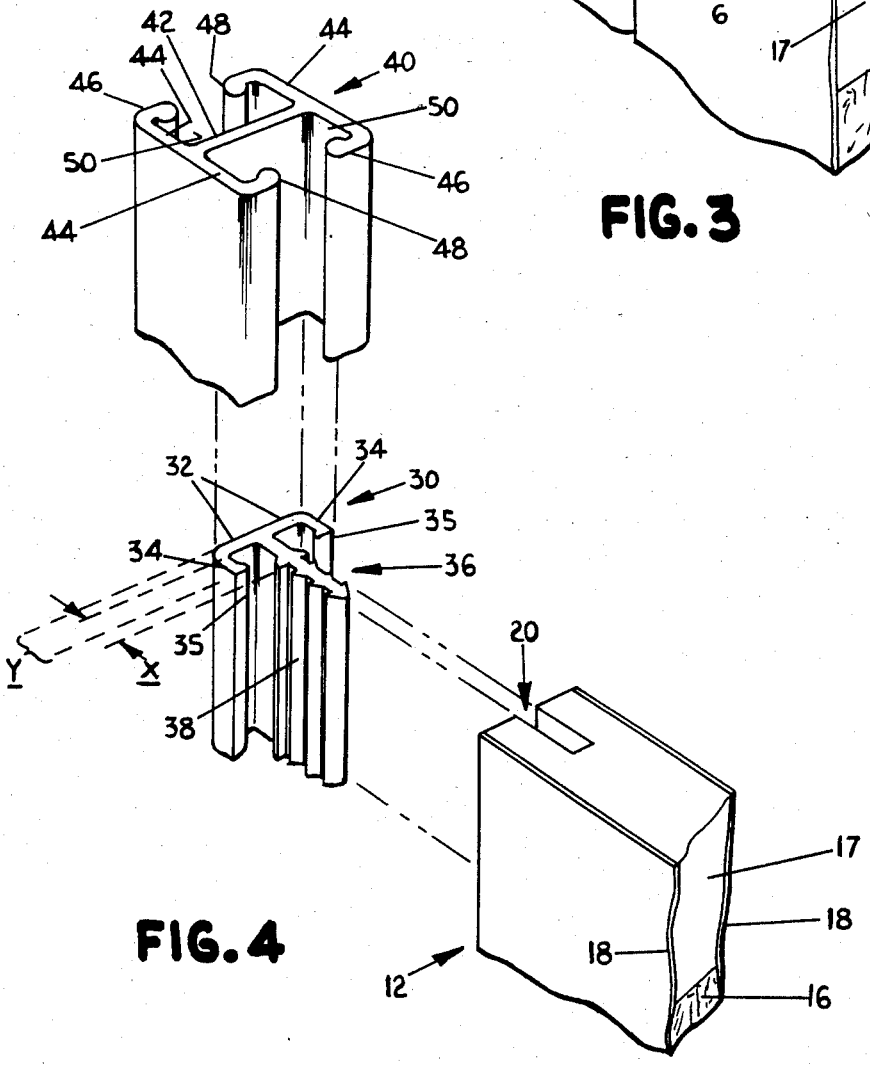
FIG. 4 is an exploded view of one modular panel showing the relative interconnecting positions of one T-shaped spline and one H-shaped connector of the joint interlocking system.
Figure 5:
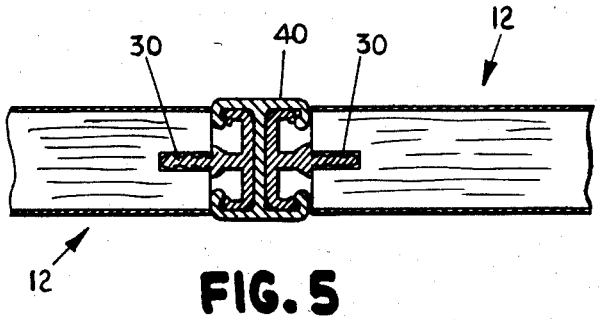
FIG. 5 is a sectional top view of the straight-line interlock joint assembly taken along lines 5—5 of FIG. 2.
Figure 6:
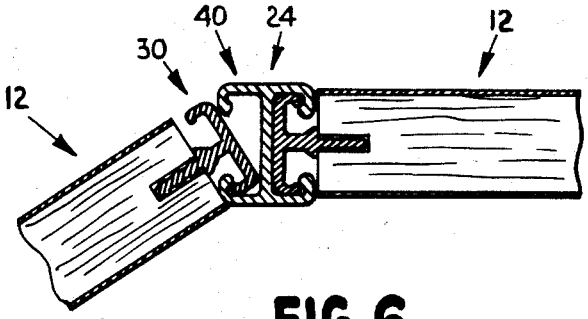
FIG. 6 is a sectional top view of the angled interlock joint assembly taken along lines 6—6 of FIG. 3.

Referring to FIGS. 2, 4 and 5, the straight-line joint assembly 22 is formed by bringing together adjoining panel edges and associated splines 30 of the two panels 12 to be interlocked. The H-shaped connector 40 is then slidably secured onto both T-shaped splines 30 in a manner so that the connector cross bracket 42 is positioned between the splines 30 and parallel to the spline arms 32. Correspondingly, each spline bead 35 is secured within one of the pockets 50 formed in the connector 40. In this configuration, each of the four connector retaining lips 46 is positioned between a corresponding pair of the four spline arms 32, lips 34, and an associated panel edge. The connector beads 48 and spline arm beads 35 are thereby relatively positioned so as to prevent the connector 40 from separating from either of the splines 30. By utilizing the beads 35 at the ends of spline lips 34 in an interlocking relationship with beads 48 on connector retaining lips 46, the splines 30 and connector 40 can be relatively sized so as to facilitate assembly and disassembly, while still providing an interlock joint assembly with relatively minimum "play" between the joint components. It should be emphasized that the spline beads 35 can be removed from the connector pockets 50 only by slidably removing the connector 40 from splines 30.

Referring to FIGS. 3, 4 and 6, the angled interlock joint assembly is formed by fitting two retaining lips 46 on one side of cross bracket 42 onto the arms 32 and lips 34 of one spline 30, with the associated spline beads 35 captured within connector pockets 50. This connection is identical to the interlocking connection of each spline 30 with connector 40 in the straight-line interlock joint assembly 22. However, in joint assembly 24, only one arm 32, lip 34 and associated bead 35 of the spline 30 secured to the other panel 12 is fitted within a pocket 50 of connector 40. The other arm 32 is positioned externally to the connector 40 as shown in FIG. 6. Again, however, the spline 30 having only one arm 32, lip 34 and bead 35 secured within a connector pocket 50 can be removed from the connector 40 only by sliding the connector 40 out of the spline 30. That is, the relationship between the distances X and Y shown in FIG. 4 is such as to prevent the retaining lip 46 from being laterally pulled through the space between the edge of panel 12 and bead 35.

In the angled interlock joint assembly 24, the panel 12 having only one arm 32 of its associated spline 30 fitted within connector 40 can be pivoted so as to allow modification of the angular configuration relative to the other panel 12 without disassembly of the joint assembly 24. In the angular configuration depicted in FIGS. 1, 3 and 6, the panels 12 are positioned at a maximum relative angle, which may be approximately 160°. In this configuration, the arm 32 external to connector 40 abuts a connector bead 48.

Figure 7:
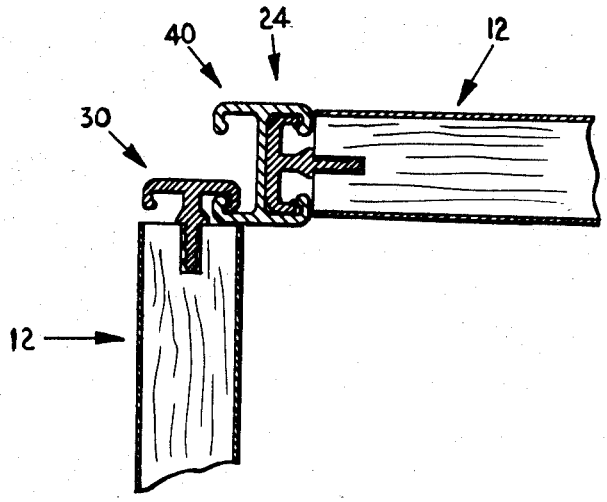
FIG. 7 is a sectional view of a perpendicular connection between two modular panels utilizing the interlock joint assembly depicted in FIG. 5.

FIG. 7 depicts an interconnection of two panels 12 utilizing an interlock joint assembly identical to the joint assembly 24 depicted in FIG. 6. However, in the FIG. 7 configuration, the panel 12 having only one spline arm 32 secured within a connector pocket 50 has been pivoted so as to provide the minimum angular relationship between the panels 12. This angular relationship will be approximately 90° and is limited in part by the contact of one leg 44 of connector 40 with the edge of the partially interlocked panel 12.

Other interlock joint assemblies can also be formed between two panels 12 using only one H-shaped connector 40. For example, in the assembly joint depicted in FIG. 8, only one arm 32 and bead 35 of each spline 30 is captured within a pocket 50 of the connector 40. With this joint assembly, each of the panels 12 can be pivoted through a predetermined angle relative to the connector 40. In the structural configuration shown in FIG. 8, the panels 12 are located in an intermediate position with one panel 12 being substantially perpendicular to the other panel 12.

Figure 8:
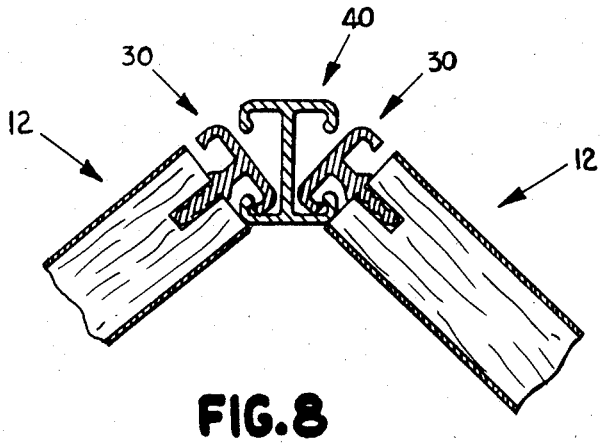
FIG. 8 is a sectional view of an interlock joint assembly with one connector and two modular panels, configured in an angular relationship.
Figure 9:
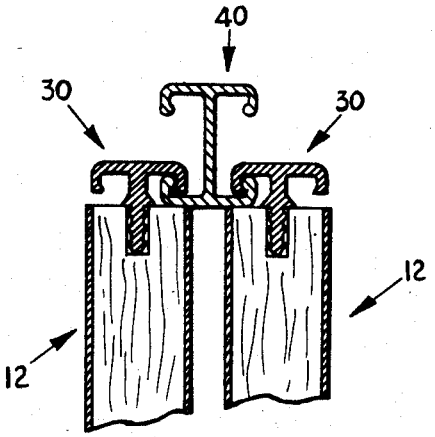
FIG. 9 is a sectional view of the interlock joint assembly shown in FIG. 8 with the modular panels rotated so as to be in an adjacent parallel relationship.

Referring to FIG. 9, the interlock joint assembly shown therein is identical to the joint assembly depicted in FIG. 8. However, in FIG. 9, the panels 12 have been rotated relative to connector 40 so as to be in a parallel adjacent relationship.

Figure 10:
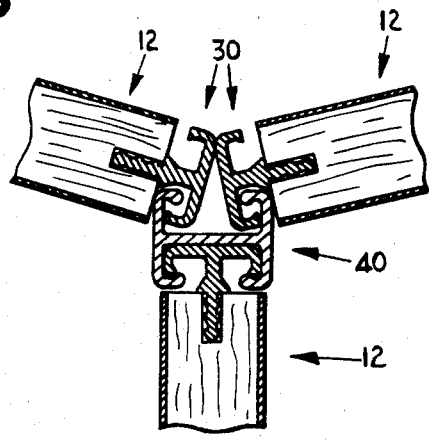
FIG. 10 is a sectional view of a three-panel interlock joint assembly utilizing one connector.

In accordance with the invention, the H-shaped connectors 40 and T-shaped splines 30 can be utilized to interlock several panels 12 together at a common joint assembly. Referring to FIG. 10, the interlock joint assembly depicted therein comprises three panels 12 with associated splines 30 and one H-shaped connector 40. The spline 30 associated with one of the panels 12 has both of its arms 32, lips 34 and beads 35 captured within the two connector pockets 50 formed on one side of cross bracket 42. Each of the splines 30 associated with the other two panels 12 has only one arm 32, lip 34 and bead 35 captured within a connector pocket 50. With this interlock joint assembly, the two panels 12 having only one associated spline arm 32 interconnected with the connector 40 can be pivoted relative to each other. The other panel 12, having both of its spline arms 32, lips 34 and beads 35 captured within connector pockets 50, remains substantially stationary relative to connector 40.

Also in accordance with the invention, interlock joint assemblies can be formed with both a plurality of panels 12 and a plurality of H-shaped connectors 40. For example, in the joint assembly depicted in FIG. 11, two H-shaped connectors 40 are utilized to interlock three panels 12. Both of the spline arms 32 and beads 35 associated with each of two of the panels 12 are captured within pockets 50 of separate connectors 40. The spline arms 32, lips 34 and beads 35 associated with the remaining panel 12 are captured within connector pockets 50 of different ones of the connectors 40.

Figure 11:
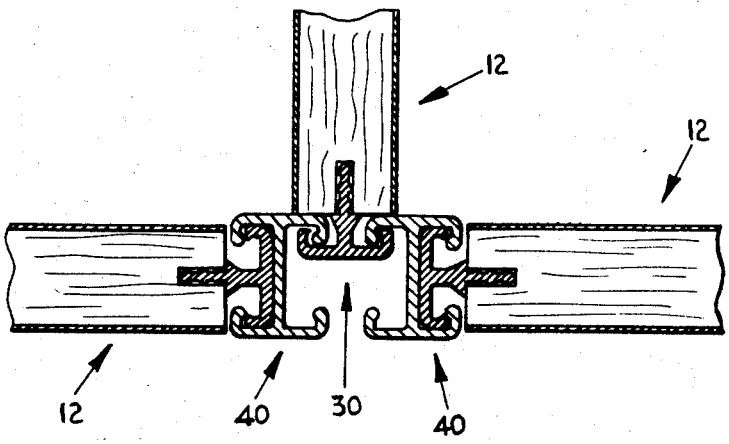
FIG. 11 is a sectional view of another three-panel interlock joint assembly utilizing two connectors.
Figure 12:
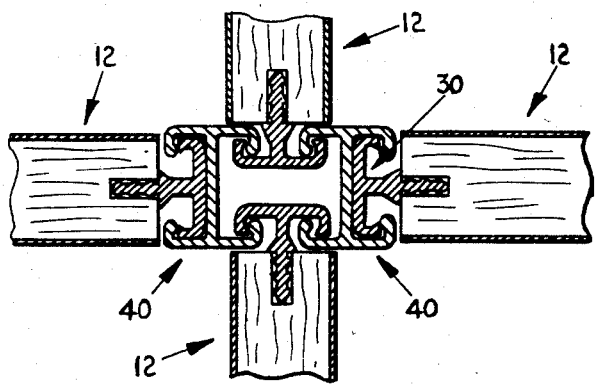
FIG. 12 is a sectional view of a four-panel interlock joint assembly utilizing two connectors.

Utilizing the joint assembly depicted in FIG. 11, a fourth panel 12 can be added to the structural configuration as shown in FIG. 12. In this joint assembly, the spline arms 32, lips 34 and beads 35 associated with the additional panel 12 are captured within the connector pockets 50 which were unused in the joint assembly shown in FIG. 11.

In the three panel interlock joint assembly shown in FIG. 11, the connectors 40 can be partially rotated relative to each other to change the angular relationship between the panels 12. When it is desirable to provide a more rigid interconnection among three panels 12, the interlock joint assembly depicted in FIG. 13 can be utilized. In this joint assembly, a total of five H-shaped connectors 40 are employed, with three of the connectors 40 interlocking both spline arms 32 of the three splines 30. The two additional H-shaped connectors 40 are interlocked to each other and fitted within pockets 50 of the first three connectors 40. With this configuration, the panels 12 form a T-shaped configuration and are substantially rigid in that none of the panels 12 can be substantially pivoted relative to the other panels 12.

When interlocking one H-shaped connector 40 to another, a pair of retaining lips 46 and associated beads 48 at one end of cross bracket 42 of one connector 40 are slidably fitted into the two connector pockets 50 on one side of the cross bracket 42 of the other connector 40. This type of interconnection is shown with the two connectors 40 in the upper portion of FIG. 13. With this type of interconnection, the connectors 40 can only be separated by slidably removing the retaining lips 46 of the one connector 40 from the pockets 50 of the other connector 40.

Figure 13:
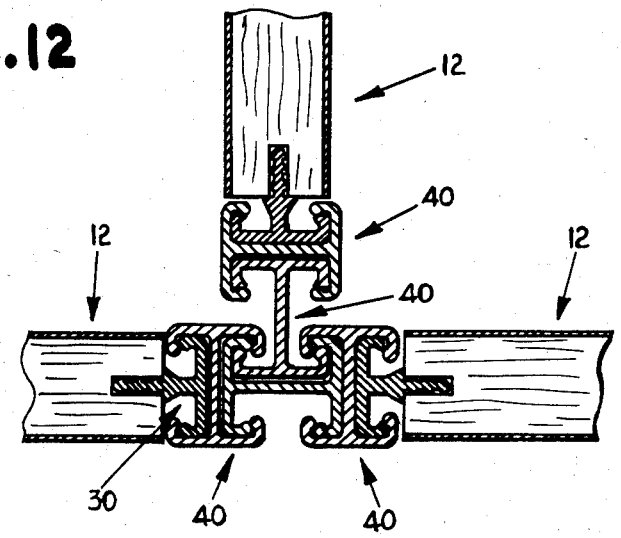
FIG. 13 is a sectional view of an interlock joint assembly utilizing five connectors for interconnecting three panels at 90° angles.

In addition, and as also shown in FIG. 13, several H-shaped connectors can be interconnected by: (1) slidably fitting the two retaining lips 46 and beads 48 on one end of a cross bracket 42 of a first connector into connector pockets 50 formed on one side of a cross bracket 42 of a second connector 40; (2) slidably fitting the two remaining retaining lips 46 and beads 48 of the first connector 40 into connector pockets 50 formed on one side of a cross bracket 42 of a third connector 40; and (3) slidably fitting the two remaining retaining lips 46 and beads 48 on one end of a cross bracket 42 of a fourth connector 40 into connector pockets 50 formed on one side of cross bracket 42 of the first connector 40, etc. In this manner, various joint assembly configurations can be designed.

Figure 14:
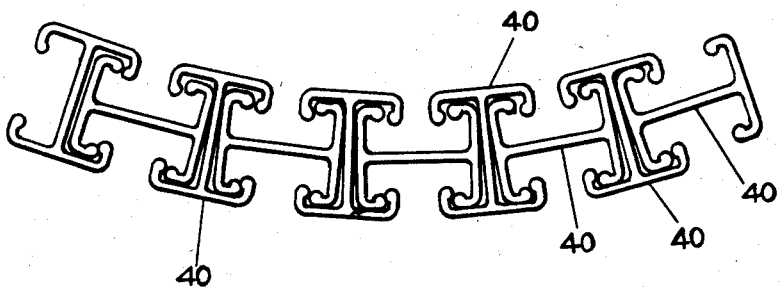
FIG. 14 is a sectional view of an interconnection of several connectors so as to provide a spaced-apart relationship between panels.

The interlock joint assemblies in accordance with the invention and heretofore described provide configurations wherein interconnected panel edges are substantially adjacent. It can be desirable to interconnect panels in a somewhat spaced apart relationship. To provide such interconnection, an interlock joint assembly as shown in FIG. 14 can be employed. The joint assembly depicted in FIG. 14 comprises a series of H-shaped connectors 40 sequentially interconnected by slidably fitting the two retaining lips 46 and beads 48 on one end of a connector cross bracket 42 within the pockets 50 formed on opposing ends of a cross bracket 42 of a next consecutive connector 40. Splines 30 of associated panels 12 (not shown in FIG. 14) can be fitted within pockets 50 of the connectors 40 at various positions along or at the ends of the connector chain. In addition to providing the spaced apart relationship between interconnected panels 12, the connector chain can be pivoted so as to form a curved interlock joint assembly as shown in FIG. 14.

Figure 15:
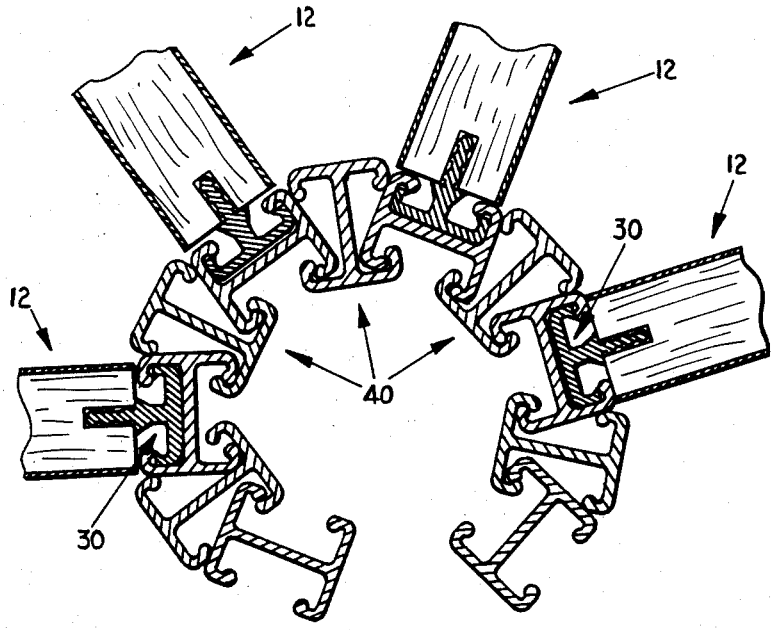
FIG. 15 is a sectional view of an interlock joint assembly wherein the connectors are arranged in a hub-like manner with the interlocked panels projecting radially outward from the hub.

Another type of modular panel configuration which is often used in trade shows and similar events is a configuration where the panels 12 radially project from a common joint assembly. Such an interlock joint assembly can be implemented in accordance with the invention by the structure shown in FIG. 15. The joint assembly includes a series of panels 12, with the spline arms 32 and beads 35 of each spline 30 captured within a pair of connector pockets 50 of separate H-shaped connectors 40. Positioned between the H-shaped connectors 40 interlocked with splines 30 of adjacent panels 12 is additional H-shaped connector 40. Each of the connectors 40 fitted onto the splines 30 include a retaining lip 46 which is fitted within a corresponding retaining lip 46 of the intermediate connector 40. In this manner, the interlock joint assembly forms a "hub", with the panels 12 projecting radially outward and spaced apart at equal distances relative to adjoining panels 12.

In summary, the various joint assemblies of joint interlocking system 10 each comprise one or more H-shaped connectors 40 having four inwardly directed retaining lips 46 which terminate in beads 48 and form pockets 50. T-shaped splines 30 include center flanges 36 which can be fitted within panel slots 20 formed in the edges of panels 12. The splines 30 have outwardly directed arms 32 terminating in lips 34 and beads 35. The connectors 40 and splines 30 are dimensioned so that the spline arms 32, lips 34 and beads 35 can be captured within the pockets 50. In each of the joint assemblies described herein, spline arms 32, lips 34 and associated beads 35 secured within the connector pockets 50 can be removed only by sliding the connector 40 completely out of the spline 30. Accordingly, the structural configurations of the splines 30 and connectors 40 allow relative ease of assembly and disassembly of the interlocking system, while still providing interlocking connections between the panels 12 in a manner so that the panels 12 will not undesirably separate. The connectors 40 and splines 30 also provide multiple types of interlocking configurations, without requiring connectors, splines and other components of different sizes and shapes for each different type of interlocking configuration. In addition, the joint interlocking system 10 provides for several different types of angular configurations between panels 12. Finally, the interlocking system 10 allows common interconnecting of several panels 12, and modification of the angular relationship between panels 12 without requiring disassembly of the interlocking joint assemblies.

The particular joint interlocking system 10 and various joint assemblies described herein are not meant to be an exhaustive enumeration of the interlocking joint assemblies which can be utilized in accordance with the invention. Accordingly, it will be apparent to those skilled in the pertinent art that modifications and variations of the above-described illustrative embodiment of the invention can be effected without departing from the spirit and scope of the novel concepts of the invention.

The embodiments of the invention in which an exclusive property or privilege is claimed are defined as follows:

1. In a joint interlocking system for interconnecting panels or similar articles in various structural configurations and comprising joint assemblies for interlocking adjacent panels, each of said panels having two opposing ends, the improvement wherein each of the joint assemblies comprises:

spline means secured to the panels for providing a panel connecting structure, and comprising a plurality of T-shaped splines, each spline having a center flange secured to an associated panel end, at least two extending arms projecting laterally from the center flange, a lip at the end of each arm projecting toward the panel end and a spline bead at the end of each lip projecting inwardly toward the center flange;

connector means for selectively interconnecting the spline means associated with different panels, and having a cross bracket, legs connected to terminating portions of the cross bracket and projecting laterally therefrom, a retaining lip at the end of each leg, a connector bead on the end of each lip and inwardly directed toward the cross bracket, and connector pockets each formed by the cross bracket, one of the legs, and the retaining lip and connector bead associated with the leg;

each of the T-shaped splines is secured to an associated panel end so that the distance between the spline center flange and each spline lip is less than the distance from the center flange to the edge of the associated panel end;

the distance between the end of each spline bead and the face of an associated panel end is larger than the thickness of each connector leg so as to allow interlock of a spline and a connector with positioning of connector legs between spline beads and panel ends; and the distance between the end of each spline bead and the face of an associated panel end is smaller than the diameter of each connector bead so as to prevent the connector beads from passing between the spline beads and the faces of associated end panels;

whereby the spline beads can be captured within the connector pockets so as to provide sliding interlocking joints therebetween; and the relative sizes and structure of the spline means and the connector means provide a joint assembly interlocking at least two panels wherein either panel can be pivoted relative to the other panel and the connector means, while maintaining an interlocked relationship with the connector means.

2. A joint interlocking system in accordance with claim 1 and further comprising a slot formed within each of the panels for receiving the center flange of an associated spline and securing the spline to the panel.

3. A joint interlocking system in accordance with claim 1 wherein the connector means comprises at least one H-shaped connector.

4. A joint interlocking system in accordance with claim 3 wherein one of the joint assemblies comprises:

a first one of the H-shaped connectors;

a first one of the T-shaped splines having two associated spline beads captured within two of the connector pockets formed on one side of the cross bracket of the first connector; and a second one of the T-shaped splines having two associated spline beads captured within two of the connector pockets formed on another side of the cross bracket of the first connector, wherein the joint assembly maintains the panels associated with the first and second splines in a straight-line relationship.

5. A joint interlocking system in accordance with claim 3 wherein one of the joint assemblies comprises:

a first one of the H-shaped connectors;

a first one of the T-shaped splines having two associated spline beads captured within two of the connector pockets formed on one side of the cross bracket of the first connector; and a second one of the T-shaped splines having only one associated spline bead captured within one of the connector pockets formed on another side of the cross bracket of the first connector, wherein the angle between the panels associated with the first and second splines can be adjusted while maintaining the interlocked relationship of the panels by pivoting the panel associated with the second spline relative to the first connector.

6. A joint interlocking system in accordance with claim 5 wherein the angle between the panels can be adjusted within a range of approximately 90° to 160°.

7. A joint interlocking system in accordance with claim 3 wherein one of the joint assemblies comprises:

a first one of the H-shaped connectors;

a first one of the T-shaped splines having only one associated spline bead captured within one of the connector pockets formed on one side of the cross bracket of the first connector; and a second one of the T-shaped splines having only one associated spline bead captured within one of the connector pockets formed on another side of the cross bracket of the first connector, wherein the angle between the panels associated with the first and second splines can be adjusted while maintaining an interlocked relationship between the panels by pivoting either of the panels associated with the first and second splines relative to the first connector.

8. A joint interlocking system in accordance with claim 7 wherein the angle between the panels can be adjusted within the range of approximately 0° to 140°.

9. A joint interlocking system in accordance with claim 3 wherein one of the joint assemblies comprises:

a first one of the H-shaped connectors;

a first one of the T-shaped splines having two associated spline beads captured within two of the connector pockets formed on one side of the cross bracket of the first connector;

a second one of the T-shaped splines having only one associated spline bead captured within one of the connector pockets formed on another side of the cross bracket of the first connector; and a third one of the T-shaped splines having only one associated spline bead captured within one of the connector pockets formed on another side of the cross bracket of the first connector, wherein the panel associated with the first spline is maintained in a substantially rigid position relative to the first connector, and the panels associated with the second and third splines are pivotable relative to the first connector.

10. A joint interlocking system in accordance with claim 3 wherein one of the joint assemblies comprises:

first and second ones of the H-shaped connectors;

a first one of the T-shaped splines having two associated spline beads captured within two of the connector pockets formed on one side of the cross bracket of the first connector;

a second one of the T-shaped splines having two associated spline beads captured within two of the connector pockets formed on one side of the cross bracket of the second connector; and a third one of the T-shaped splines having one associated spline bead captured within one of the connector pockets formed on another side of the cross bracket of the first connector, and further having another associated spline bead captured within one of the connector pockets formed on another side of the cross bracket of the second connector.

11. A joint interlocking system in accordance with claim 10 wherein the one joint assembly further comprises a fourth one of the T-shaped splines having one associated spline bead captured within one of the connector pockets formed on another side of the cross bracket of the first connector, and further having another associated spline bead captured within one of the connector pockets formed on another side of the cross bracket of the second connector.

12. A joint interlocking system in accordance with claim 3 wherein one of the joint assemblies comprises:

a first one of the H-shaped connectors;

a second one of the H-shaped connectors having two associated retaining lips connected to one end of its cross bracket captured within the connector pockets formed on one side of the cross bracket of the first connector; and a third one of the H-shaped connectors, wherein two associated retaining lips connected to another end of the cross bracket of the second connector are captured within the connector pockets formed on one side of the cross bracket of the third connector, wherein the first, second and third connectors form a chain for interlocking the panel edges in a spaced apart relationship.

13. A joint interlocking system in accordance with claim 3 wherein one of the joint assemblies provides a structural configuration having a plurality of interlocked panels projecting radially outward from the joint assembly, said assembly comprising:

a plurality of the T-shaped splines and H-shaped connectors, wherein each spline is interlocked to a different one of the connectors; and additional H-shaped connectors, each positioned intermediate two of the plurality of H-shaped connectors interlocked to splines associated with adjacent panels.

14. A joint interlocking system for interconnecting articles in various structural configurations and comprising:

at least one elongated connector having pockets formed axially along the connector and open at one end of the connector, the connector comprising a cross bracket, a plurality of legs perpendicularly extending from the cross bracket, a plurality of retaining lips each extending from a terminating end of each leg, and a plurality of connector beads each formed on a terminating end of one of the retaining lips and inwardly-directed toward the cross bracket, wherein each of the connector pockets is formed by the cross bracket, one of the retaining lips and one of the connector beads;

a plurality of elongated splines, each comprising a center flange secured to an interconnected article, two extending arms perpendicularly extending from the center flange, a lip connected to the end of each arm and extending towards the interconnected article, and a spline bead on each lip inwardly-directed toward the center flange;

each spline bead is slidably receivable within a connector pocket through the open connector end and each spline bead and connector pocket is relatively shaped so as to prevent lateral separation of the interconnected splines and connector;

interlocking of one of the splines through the connector is maintained by slidably receiving at least one of the spline beads within one of the connector pockets; and one of the splines can be interlocked to the connector by slidably receiving two of the spline beads within separate connector pockets each on the same side of the cross bracket so as to maintain a rigid connection between the spline and connector.

15. A joint interlocking system in accordance with claim 14 and comprising an additional connector identical to the at least one connector, wherein the connectors are shaped so as to provide a sliding interlocking joint when two of the retaining lips and connector beads at one end of the cross bracket of the additional connector are slidably received within two connector pockets on one side of the cross bracket of the at least one connector.

* * * * *